US007425943B2

(12) United States Patent
Furukawa

(10) Patent No.: US 7,425,943 B2
(45) Date of Patent: Sep. 16, 2008

(54) CONSTANT CURRENT DRIVING DEVICE, BACKLIGHT LIGHT SOURCE DEVICE, AND COLOR LIQUID CRYSTAL DISPLAY DEVICE

(75) Inventor: Norimasa Furukawa, Tokyo (JP)

(73) Assignee: Sony Corporation, Tokyo (JP)

( * ) Notice: Subject to any disclaimer, the term of this patent is extended or adjusted under 35 U.S.C. 154(b) by 718 days.

(21) Appl. No.: 11/107,124

(22) Filed: Apr. 15, 2005

(65) Prior Publication Data

US 2005/0231459 A1 Oct. 20, 2005

(30) Foreign Application Priority Data

Apr. 20, 2004 (JP) ..... P2004-124794

(51) Int. Cl.
*G09G 3/36* (2006.01)

(52) U.S. Cl. ..... 345/102

(58) Field of Classification Search ..... 345/82, 345/83, 102

See application file for complete search history.

(56) References Cited

U.S. PATENT DOCUMENTS 6,153,980 A * 11/2000 Marshall et al. ..... 315/200 A
7,317,287 B2 * 1/2008 Blumel ..... 315/291
2007/0159750 A1 * 7/2007 Peker et al. ..... 361/93.1

* cited by examiner

*Primary Examiner*—Sumati Lefkowitz
*Assistant Examiner*—Ke Xiao
(74) *Attorney, Agent, or Firm*—Sonnenschein Nath & Rosenthal LLP

(57) ABSTRACT

A constant current driving device for constant current driving of a plurality of elements connected in series with each other by a pulse width modulation constant current driving circuit includes: switching elements respectively connected in parallel with the plurality of elements connected in series with each other; a control circuit for performing control to bypass a driving current flowing through the other elements than an arbitrary element to be measured via the respective switching elements and pass a measuring driving current through only the element to be measured; and a detecting circuit for identifying an element at a faulty position by detecting the driving current flowing through the plurality of elements connected in series with each other.

16 Claims, 17 Drawing Sheets

CONSTANT CURRENT DRIVING DEVICE, BACKLIGHT LIGHT SOURCE DEVICE, AND COLOR LIQUID CRYSTAL DISPLAY DEVICE

BACKGROUND OF THE INVENTION

The present invention relates to a constant current driving device for constant current driving of a plurality of elements, for example light emitting diodes (LEDs) connected in series with each other by a pulse width modulation constant current driving circuit, a backlight light source device driven by the constant current driving device, and a color liquid crystal display device.

As is typified by liquid crystal panels and plasma display panels (PDPs), there has recently been a trend toward thinner displays. Among the displays, many displays for mobile use are liquid crystal panels, which are desired to have faithful color reproducibility. While a mainstream backlight for liquid crystal panels is a CCFL (Cold Cathode Fluorescent Lamp) type using a fluorescent tube, mercury-less backlights have been requested from an environmental point of view. Light emitting diodes and the like are considered to be promising as a light source to replace the CCFL.

Generally, a display using light emitting diodes as display pixels requires an X-Y addressing driving circuit for the pixels to perform matrix driving of the light emitting diodes. The X-Y addressing driving circuit selects a light emitting diode at a position of a pixel desired to be lit (addressing), and adjusts brightness of the light emitting diode by varying a lighting time by pulse width modulation (PWM), whereby a display screen with a predetermined gradation is obtained. Therefore the driving circuit is complex and requires a high cost (see Japanese Patent Laid-Open No. 2001-272938, for example).

Light emitting diodes also have life. Failure of an individual element is roughly divided into three types: (1) a failure in an OPEN mode in which a disconnection occurs; (2) a failure in a Short mode in which a short circuit occurs; and (3) a mode that is neither of the above modes and in which a decrease in light quantity occurs.

To detect these failures requires employment of a method of driving each LED element by an independent driving circuit and construction of a system for feeding back a state of operation of each element at all times, which increases cost and is thus difficult to realize in an actual apparatus.

There are image displays using light emitting diodes as individual light emitting pixels. In matrix type driving in this case, there has conventionally been no system having a function of individually determining a failure of each of light emitting diode elements as described above and further eliminating the failure.

In a case where light emitting diodes are used as a backlight for a liquid crystal display, power to each light emitting diode is high, and the number of light emitting diodes is relatively small. Therefore, when a part is unlit due to a failure, unevenness or the like occurs, which is not comfortable to the eye. A matrix driving LSI or the like for high power driving in LED driving devices for a lighting purpose has not been created, and is practically disadvantageous in terms of cost. Therefore a series connection form is used. However, in the series connection form, when a failure occurs in an individual light emitting diode and the failure is a disconnection, all light emitting diodes in the row are not lit, thus causing considerable color unevenness.

SUMMARY OF THE INVENTION

Accordingly, in view of the related-art situation as described above, it is an object of the present invention to provide a constant current driving device, a backlight light source device driven by the constant current driving device, and a color liquid crystal display device that can identify a position of a faulty element at a time of a failure and bypass an element current at the faulty position in constant current driving of elements, for example light emitting diodes connected in series with each other.

Other and further objects of the present invention and concrete advantages obtained by the present invention will become more apparent from the following description of embodiments.

According to a first aspect of the present invention, there is provided a constant current driving device for constant current driving of a plurality of elements connected in series with each other by a pulse width modulation constant current driving circuit, the constant current driving device comprising: switching elements respectively connected in parallel with the plurality of elements connected in series with each other; a control circuit for performing control to bypass a driving current flowing through the other elements than an arbitrary element to be measured via the respective switching elements and pass a measuring driving current through only the element to be measured; and a detecting circuit for identifying an element at a faulty position by detecting the driving current flowing through the plurality of elements connected in series with each other.

In addition, according to a second aspect of the present invention, there is provided a backlight light source device for lighting a display panel from a back side of the display panel, the backlight light source device comprising: a plurality of light emitting diodes connected in series with each other; switching elements respectively connected in parallel with the plurality of light emitting diodes connected in series with each other; a control circuit for performing control to bypass a driving current flowing through the other light emitting diodes than an arbitrary light emitting diode to be measured via the respective switching elements and pass a measuring driving current through only the light emitting diode to be measured; and a detecting circuit for identifying a light emitting diode at a faulty position by detecting the driving current flowing through the plurality of light emitting diodes connected in series with each other.

Further, according to a third aspect of the present invention, there is provided a color liquid crystal display device comprising: a transmissive type color liquid crystal display panel having a color filter; and a backlight light source device for lighting the color liquid crystal display panel from a back side of the color liquid crystal display panel; wherein the backlight light source device includes: a plurality of light emitting diodes connected in series with each other; switching elements respectively connected in parallel with the plurality of light emitting diodes connected in series with each other; a control circuit for performing control to bypass a driving current flowing through the other light emitting diodes than an arbitrary light emitting diode to be measured via the respective switching elements and pass a measuring driving current through only the light emitting diode to be measured; and a detecting circuit for identifying a light emitting diode at a faulty position by detecting the driving current flowing through the plurality of light emitting diodes connected in series with each other.

In the present invention, a control circuit performs control to bypass a driving current flowing through other elements than an arbitrary element to be measured via switching elements respectively connected in parallel with a plurality of the elements connected in series with each other and pass a measuring driving current through only the element to be measured. It is thus possible to identify an element at a faulty position by detecting the driving current flowing through the plurality of elements connected in series with each other by a detecting circuit.

In addition, in the present invention, a main constant current circuit for constant current driving of the plurality of light emitting diodes connected in series with each other by a pulse width modulation constant current driving circuit and a measuring reference constant current circuit are selectively connectable to the plurality of light emitting diodes connected in series with each other via a switching unit. Therefore a measuring reference constant current can be fed from the measuring reference constant current circuit to detect a failure in the light emitting diodes.

Further, the control circuit performs control to bypass the driving current flowing to the element at the faulty position at all times by operating a switching element formed by a transistor connected in parallel with the element at the faulty position, the element at the faulty position being identified by the detecting circuit, in synchronism with PWM driving by the pulse width modulation constant current driving circuit. It is thereby possible to bypass the element current at the faulty position via the switching element.

DETAILED DESCRIPTION OF THE PREFERRED EMBODIMENTS

Preferred embodiments of the present invention will hereinafter be described in detail with reference to the drawings. It is to be noted that the present invention is not limited to the following examples, and that of course the present invention is susceptible of arbitrary changes without departing from the spirit of the present invention.

Figure 1:
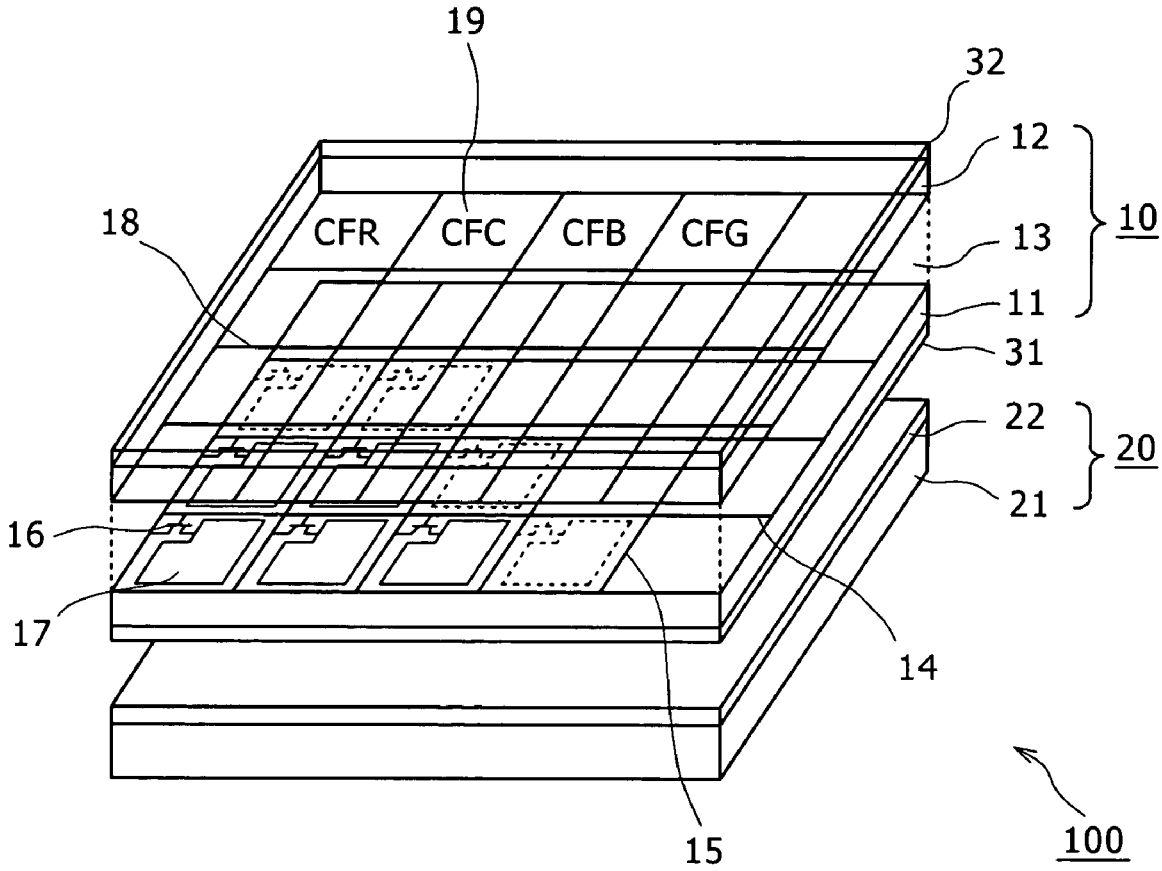
FIG. 1 is a schematic perspective view of a structure of a backlight type color liquid crystal display device to which the present invention is applied.

The present invention is applied to a backlight type color liquid crystal display device 100 of a configuration as shown in FIG. 1, for example.

The color liquid crystal display device 100 comprises a transmissive type color liquid crystal display panel 10 and a backlight light source device 20 provided on a back side of the color liquid crystal display panel 10.

The transmissive type color liquid crystal display panel 10 has a structure in which two transparent substrates (a TFT substrate 11 and a counter electrode substrate 12) formed of glass or the like are opposed to each other, and a liquid crystal layer 13 is provided by filling a twisted nematic (TN) liquid crystal, for example, into a gap between the substrates. Formed on the TFT substrate 11 are signal lines 14 and scanning lines 15 arranged in a form of a matrix as well as thin-film transistors 16 as switching elements arranged at intersections of the signal lines 14 and the scanning lines 15, and pixel electrodes 17. The thin-film transistors 16 are sequentially selected by the scanning lines 15, and video signals supplied from the signal lines 14 are written to the corresponding pixel electrodes 17. On the other hand, a counter electrode 18 and a color filter 19 are formed on an inner surface of the counter electrode substrate 12.

In the color liquid crystal display device 100, the transmissive type color liquid crystal display panel 10 of such a structure is sandwiched between two polarizing plates 31 and 32. The color liquid crystal display panel 10 is driven by an active matrix system in a state of being irradiated with white light from the back side by the backlight light source device 20, whereby a desired full-color image is displayed.

The backlight light source device 20 comprises a light source 21 and a wavelength selecting filter 22. The backlight light source device 20 irradiates the color liquid crystal display panel 10 from the back side thereof with light emitted by the light source 21 via the wavelength selecting filter 22.

Figure 2:
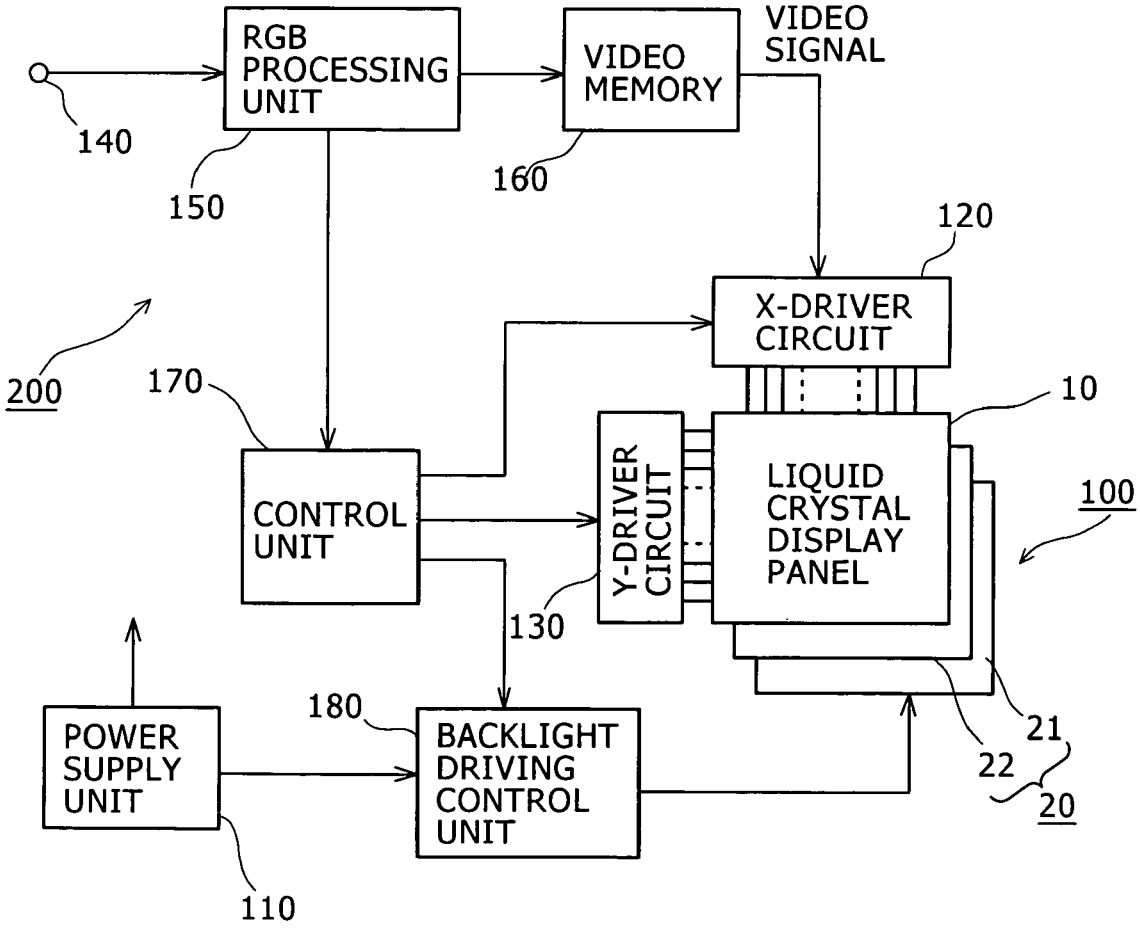
FIG. 2 is a block diagram showing a configuration of a driving circuit for driving the color liquid crystal display device.

The color liquid crystal display device 100 is driven by a driving circuit 200, whose electrical block configuration is shown in FIG. 2, for example.

The driving circuit 200 includes for example: a power supply unit 110 for supplying driving power for the color liquid crystal display panel 10 and the backlight light source device 20; an X-driver circuit 120 and a Y-driver circuit 130 for driving the color liquid crystal display panel 10; an RGB processing unit 150 externally supplied with a video signal via an input terminal 140; a video memory 160 and a control unit 170 connected to the RGB processing unit 150; and a backlight driving control unit 180 for driving control of the backlight light source device 20.

A video signal input into the driving circuit 200 via the input terminal 140 is subjected to signal processing such as chroma processing and the like, further converted from a composite signal into an RGB signal suitable for driving the color liquid crystal display panel 10, and then supplied to the control unit 170 and supplied to the X-driver circuit 120 via the video memory 160. The control unit 170 controls the X-driver circuit 120 and the Y-driver circuit 130 in predetermined timing corresponding to the RGB signal to thereby drive the color liquid crystal display panel 10 with the RGB signal supplied to the X-driver circuit 120 via the video memory 160, whereby an image corresponding to the RGB signal is displayed.

Figure 3A:
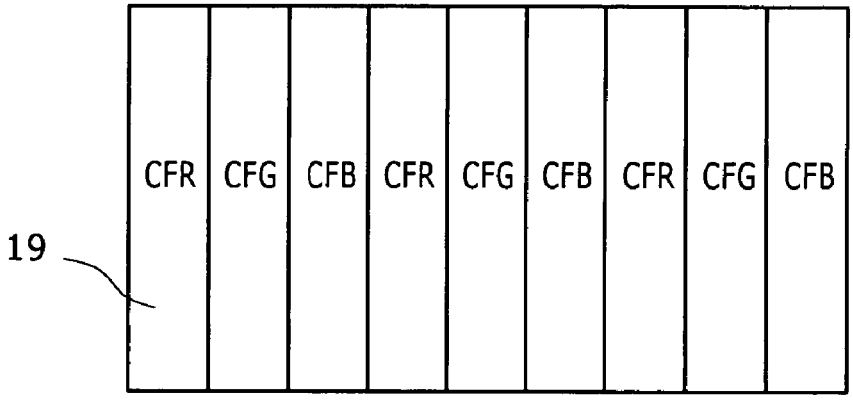
FIGS. 3A, 3B, and 3C are schematic plan views of arrangements of color filters provided in a color liquid crystal panel in the color liquid crystal display device.
Figure 3B:
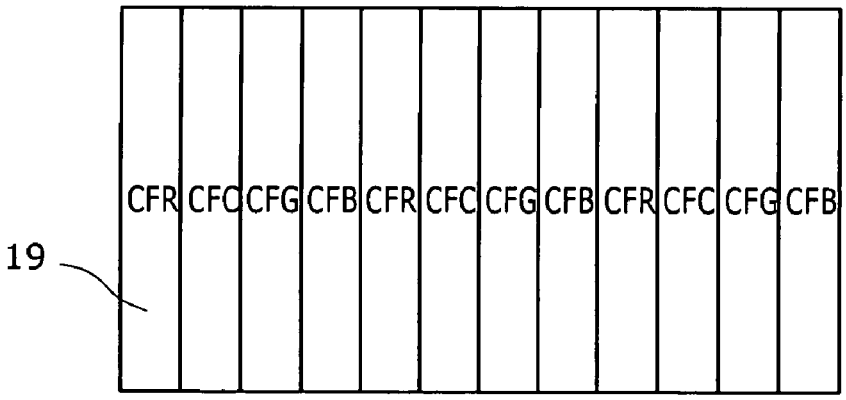
Figure 3C:
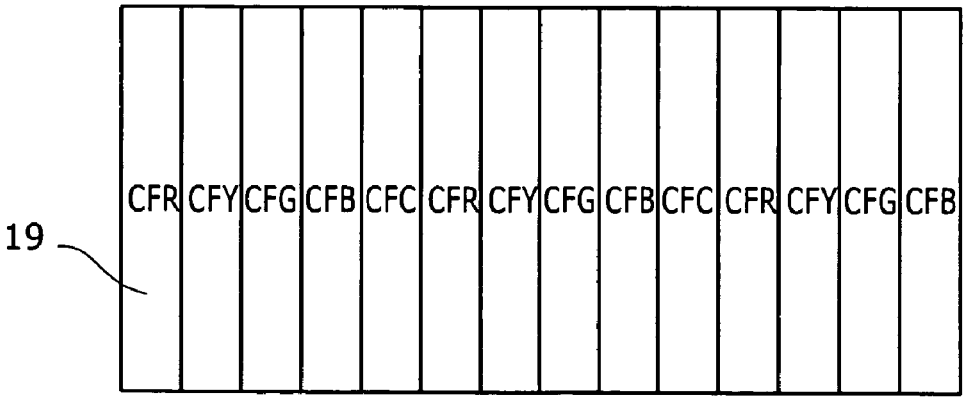

The color filter 19 is divided into a plurality of segments corresponding to the respective pixel electrodes 17. For example, the color filter 19 is divided into three segments of three primary colors, that is, a red color filter CFR, a green color filter CFG, and a blue color filter CFB as shown in FIG. 3A, four segments of the three primary colors (RGB) plus cyan (C), that is, a red color filter CFR, a cyan color filter CFC, a green color filter CFG, and a blue color filter CFB as shown in FIG. 3B, or five segments of the three primary colors (RGB) plus cyan (C) and yellow (Y), that is, a red color filter CFR, a cyan color filter CFC, a green color filter CFG, a yellow color filter CFY, and a blue color filter CFB as shown in FIG. 3C.

In this case, an area light configuration light source 21 that irradiates the transmissive type color liquid crystal display panel 10 by a plurality of light emitting diodes (LEDs) disposed on the back side of the color liquid crystal display panel 10 is used in the backlight light source device 20.

An arrangement of light emitting diodes in the light source 21 of the backlight light source device 20 will be described.

Figure 4:
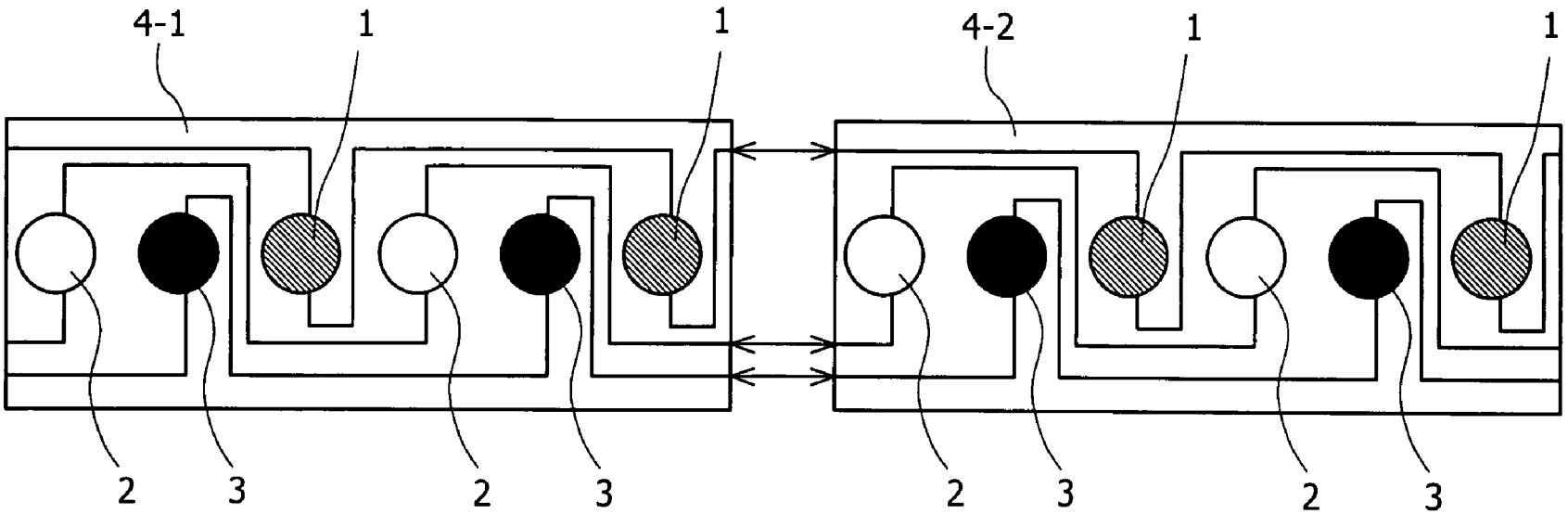
FIG. 4 is a diagram schematically showing an example of arrangement of light emitting diodes in a backlight light source device for forming the color liquid crystal display device.

FIG. 4 shows a state, as an example of arrangement of light emitting diodes, in which two red light emitting diodes 1, two green light emitting diodes 2, and two blue light emitting diodes 3 are used and thus a total of six light emitting diodes are arranged in a row in each of unit cells 4-1 and 4-2.

While six light emitting diodes are arranged in this arrangement example, the number of light emitting diodes allocated for each color can be varied other than that in the present example because of a need for adjusting a balance of light output to make mixed color well-balanced white light on the basis of rating, luminous efficiency and the like of the light emitting diodes being used.

Figure 5:
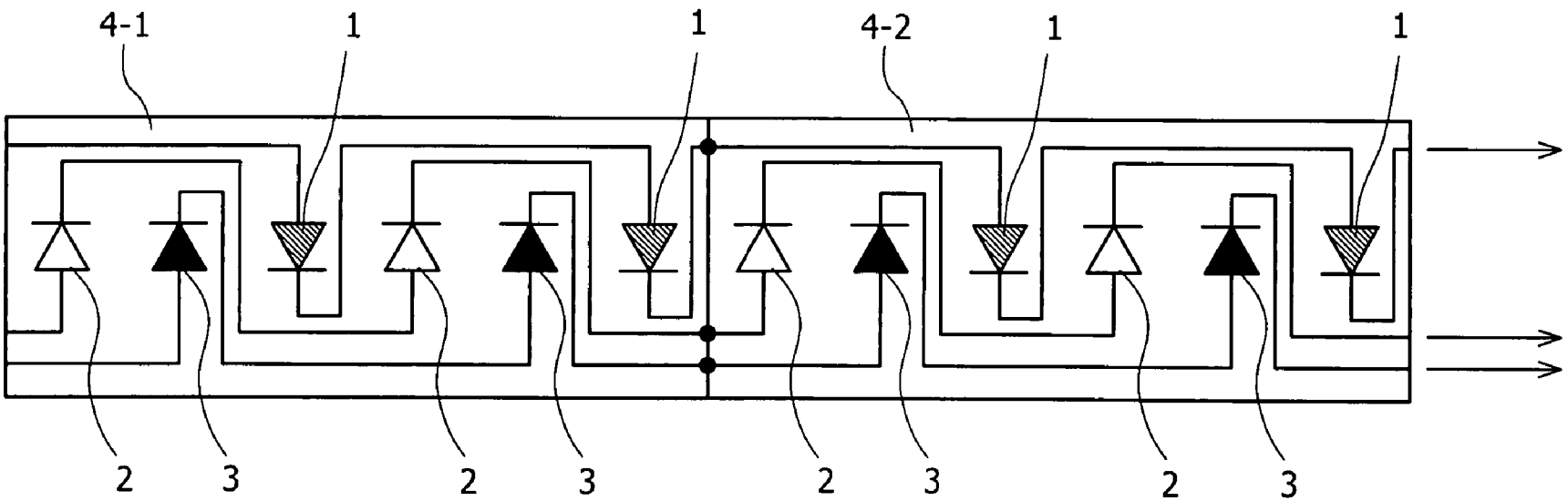
FIG. 5 is a diagram schematically showing, by diode marks as an electric circuit diagram symbol, a form of the light emitting diodes being connected to each other in the example of arrangement of the light emitting diodes.

In the arrangement example shown in FIG. 4, the unit cell 4-1 and the unit cell 4-2 are identical with each other, and are connected to each other at central parts indicated by double-headed arrows. FIG. 5 illustrates a form of the unit cell 4-1 and the unit cell 4-2 being connected to each other by diode marks as an electric circuit diagram symbol. In this example, the light emitting diodes, that is, the red light emitting diodes 1, the green light emitting diodes 2, and the blue light emitting diodes 3 are connected in series with each other with polarity thereof set in a direction to pass current from a left to a right.

Figure 6:
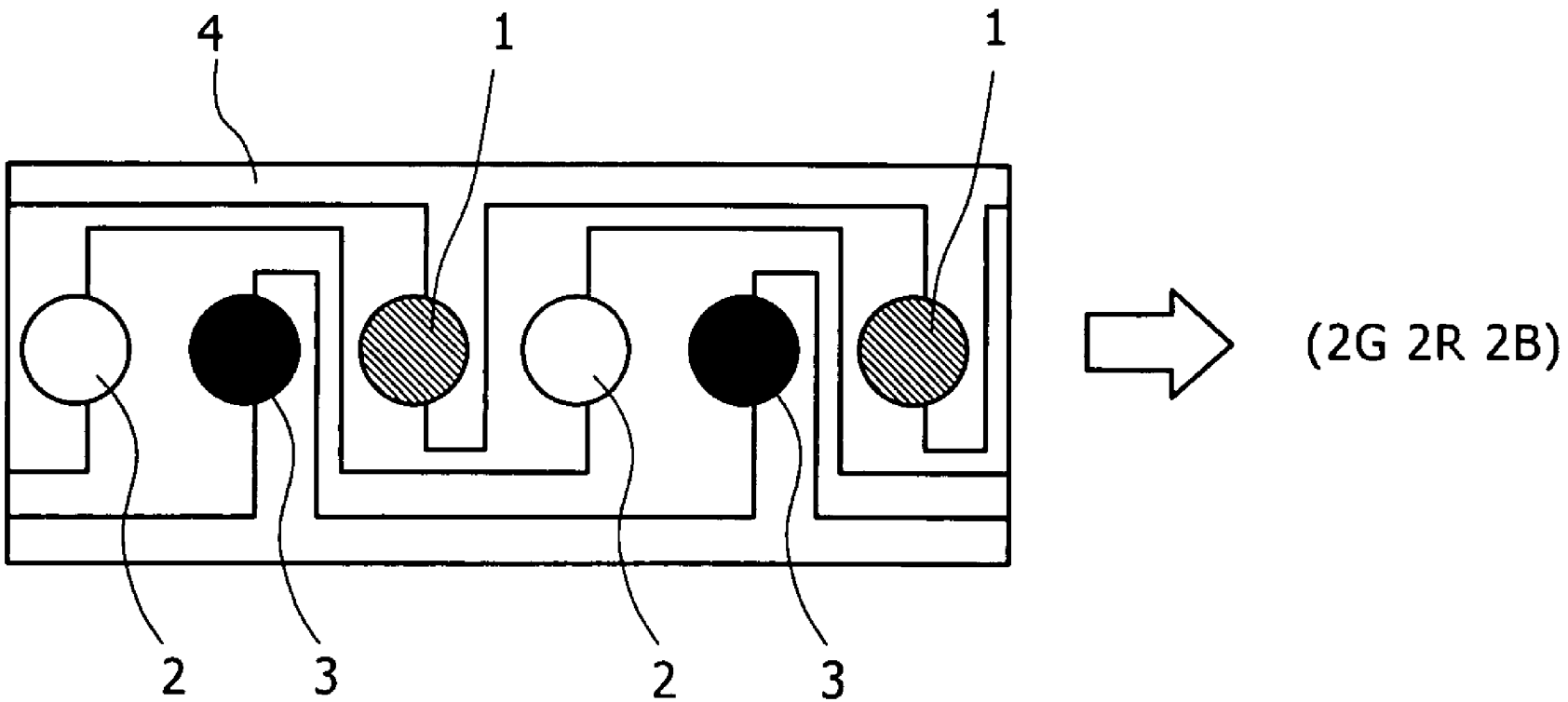
FIG. 6 is a diagram schematically showing a unit cell in which two red light emitting diodes, two green light emitting diodes, and two blue light emitting diodes are used and thus a total of six light emitting diodes are arranged in a row, together with a pattern notation using the number of light emitting diodes for each color which notation represents the unit cell.
Figure 7:
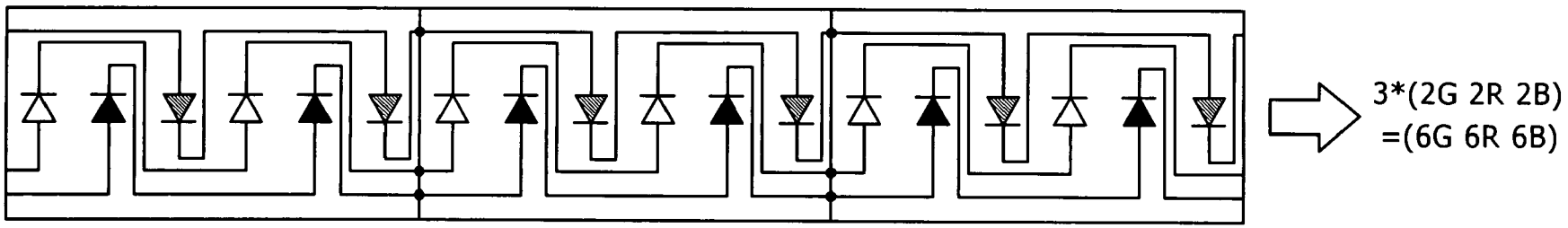
FIG. 7 is a diagram schematically showing three unit cells as basic units connected in series with each other, together with a pattern notation using the numbers of light emitting diodes which notation represents the three unit cells.

As shown in FIG. 6, (2G 2R 2B) is a pattern notation using the number of light emitting diodes for each color which notation represents a unit cell 4 in which two red light emitting diodes 1, two green light emitting diodes 2, and two blue light emitting diodes 3 are used and thus a total of six light emitting diodes are arranged in a row. That is, (2G 2R 2B) denotes that a pattern of a total of six light emitting diodes comprising two green light emitting diodes, two red light emitting diodes, and two blue light emitting diodes is used as a basic unit. As shown in FIG. 7, three unit cells 4 as the basic units connected in series with each other are represented by a notation of 3*(2G 2R 2B), and by a pattern notation of (6G 6R 6B) based on the numbers of light emitting diodes.

An example of actual arrangement of light emitting diodes in the light source 21 of the backlight light source device 20 will next be described on the basis of the notation of FIG. 7.

Figure 8:
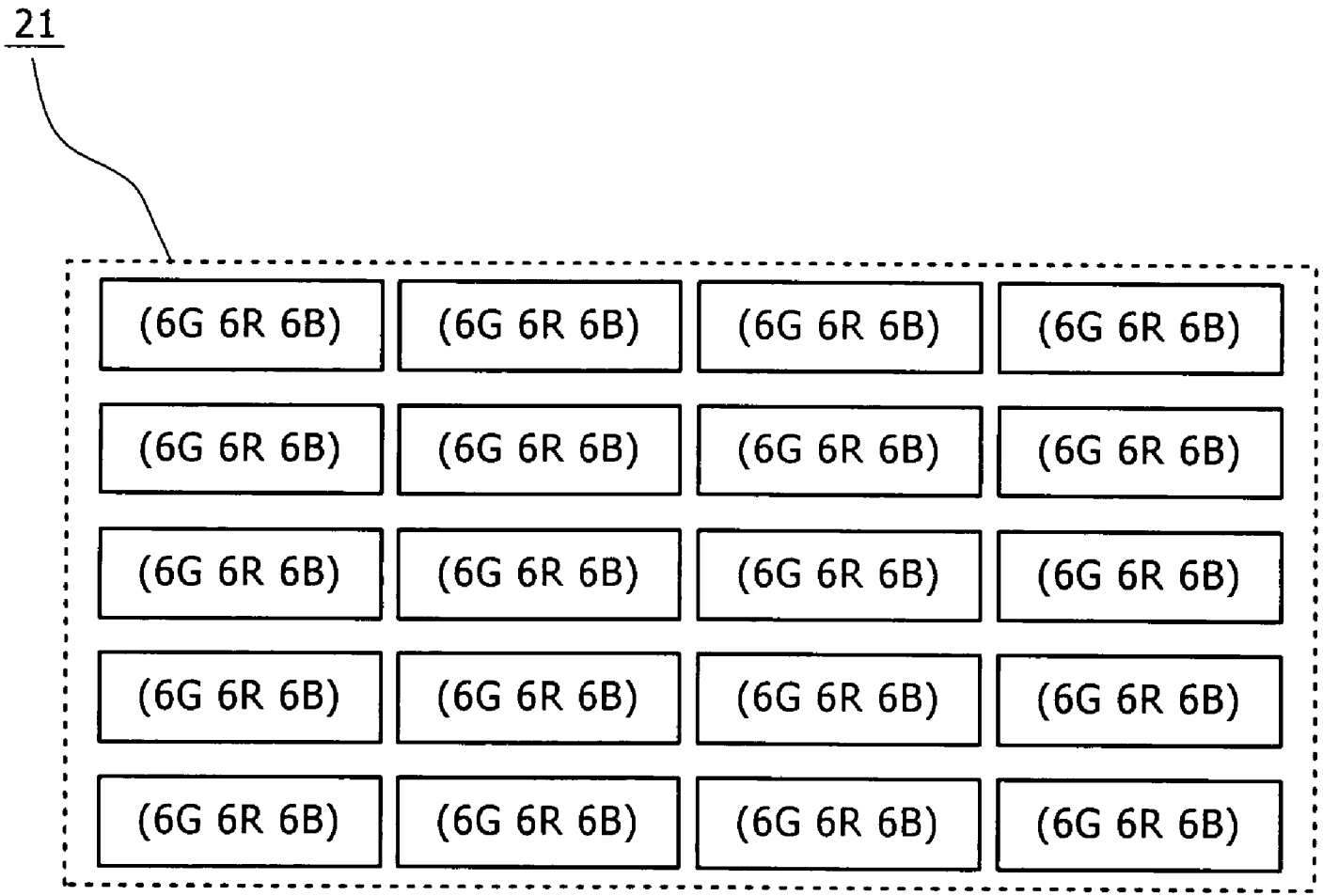
FIG. 8 is a diagram schematically showing an example of actual arrangement of light emitting diodes in a light source of the backlight light source device by a pattern notation using the numbers of LEDs.

As shown in FIG. 8, with three basic units (2G 2R 2B) of light emitting diodes as described above as one medium unit (6G 6R 6B), a total of 360 light emitting diodes comprising four vertical columns and five horizontal rows of medium units are arranged in the light source 21.

Figure 9:
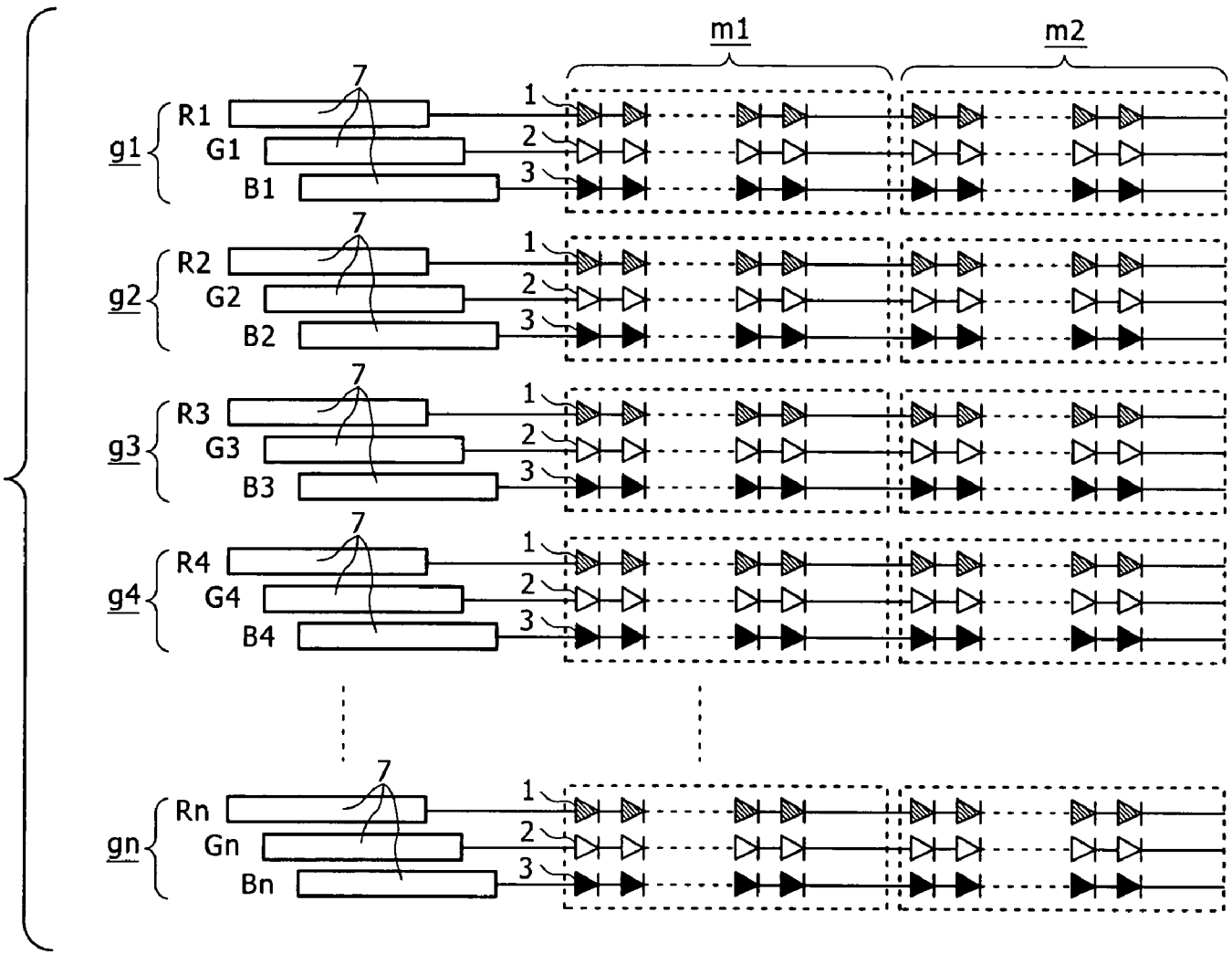
FIG. 9 is a diagram schematically showing a configuration for driving light emitting diodes in the backlight light source device.

Since it is not easy to perform individual addressing of all the 360 light emitting diodes, the backlight light source device 20 has a driving configuration as shown in FIG. 9.

Specifically, RGB pairs g1 to gn corresponding to n respective rows are formed by serially connecting each of red light emitting diodes, green light emitting diodes, and blue light emitting diodes independently of the others in each row, and are supplied with a constant current by a DC-to-DC converter 7.

A concrete example for passing a constant current through LED series connection substrates m1 and m2 will be described with reference to FIG. 10.

An LED string 40 formed by connecting a plurality of light emitting diodes LED1 to LEDn in series with each other has one end connected to a DC-to-DC converter 7 via a detection resistance (Rc) 5, and another end grounded via a FET 6.

The DC-to-DC converter 7 forms a feedback loop to detect a voltage drop by the detection resistance 5 from a setting of an output voltage Vcc and pass a predetermined constant current ILED through the serially connected LED string. In this example, the voltage dropped by the detection resistance 5 is fed back via a sample-and-hold circuit provided within the DC-to-DC converter 7.

Incidentally, while in this example, the sample-and-hold circuit is provided in the current detection feedback loop to control the constant current by a peak value, this is one example, and thus another method may be used.

The current flowing through the LED string 40 is turned on and off for a predetermined period of time by a main_PWM (Pulse Width Modulation) signal applied to a gate of the FET 6 from a driver IC 181 provided in the backlight driving control unit 180, whereby an amount of emission by the light emitting diodes is increased or decreased.

That is, the backlight light source device 20 makes the FET 6 perform switching operation by the main_PWM signal supplied from the driver IC 181 provided in the backlight driving control unit 180 to thereby turn on and off the driving current supplied from the DC-to-DC converter 7 to the LED string 40 formed by connecting the plurality of light emitting diodes LED1 to LEDn in series with each other, whereby pulse width modulation constant current driving of the light emitting diodes LED1 to LEDn is performed.

Also provided in this configuration example are: a DC-to-DC converter 70 as a measuring reference constant current circuit for passing a measuring reference constant current through the LED string 40; a detection resistance (Rref) 50 connected to the DC-to-DC converter 70; and a selector switch 60. One end of the LED string 40 is selectively connected via the selector switch 60 to the DC-to-DC converter 7 as a main constant current circuit for passing the driving current through the LED string 40 and the DC-to-DC converter 70 as the measuring reference constant current circuit for passing the measuring reference constant current through the LED string 40.

Further, switching elements SW1 to SWn are connected in parallel with the light emitting diodes LED1 to LEDn, respectively, so that the driving current flowing through the plurality of light emitting diodes LED1 to LEDn connected in series with each other can be bypassed via the switching elements SW1 to SWn individually.

Thus, in constant current driving of the plurality of light emitting diodes LED1 to LEDn connected in series with each other by the pulse width modulation constant current driving circuit, the driving current flowing through the plurality of light emitting diodes LED1 to LEDn connected in series with each other can be bypassed via the switching elements SW1 to SWn individually, whereby a failure in the individual light emitting diodes can be detected.

Figure 11:
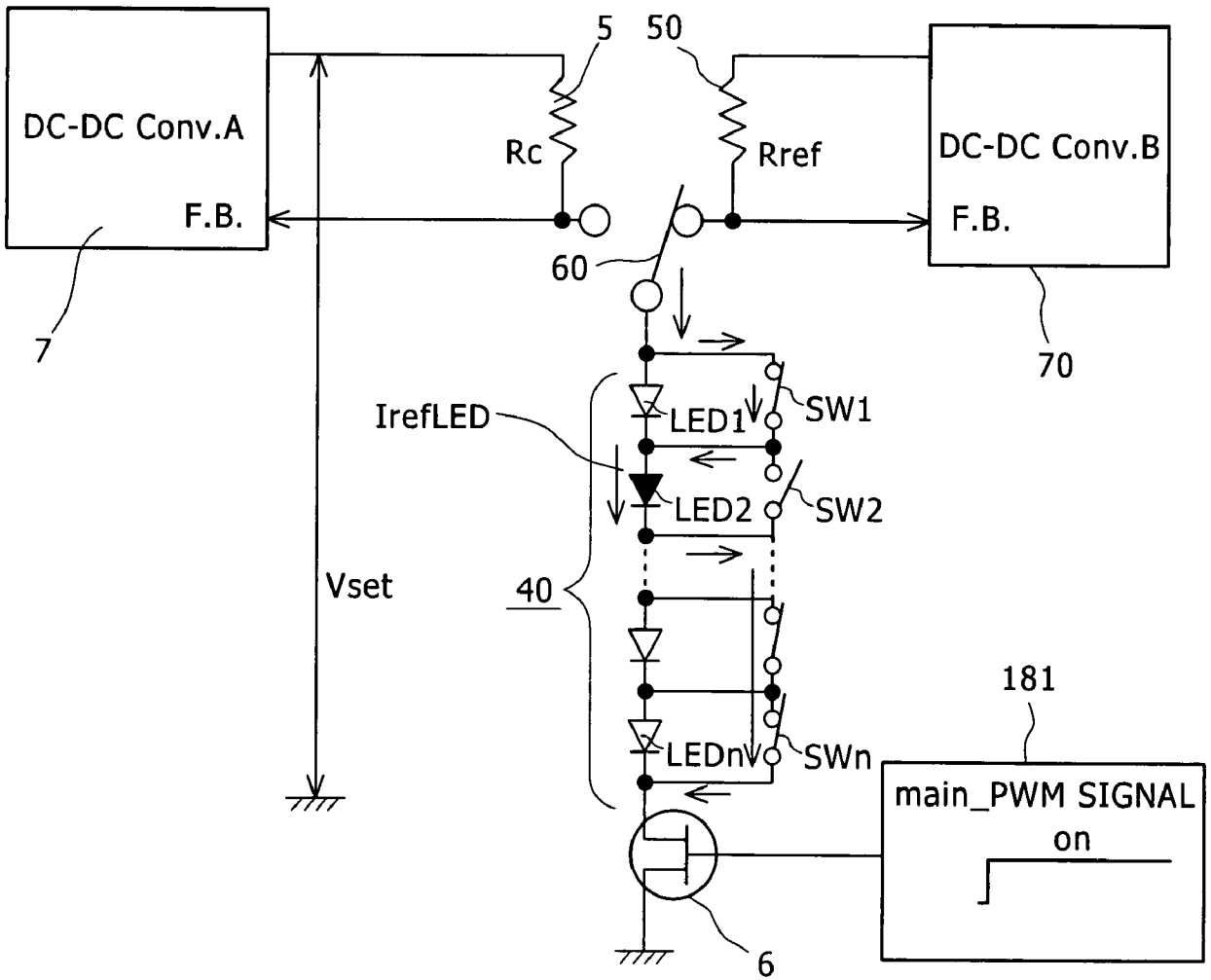
FIG. 11 is a diagram schematically showing a concrete example of a configuration for detecting a failure of each element of the plurality of light emitting diodes connected in series with each other in the backlight light source device.

In order to drive the LED string 40 formed by connecting the large number of light emitting diodes LED1 to LEDn requiring a relatively high voltage in series with each other, the DC-to-DC converter 7 as the main constant current circuit for supplying the driving current at a normal time of lighting requires a withstand voltage and has large components. On the other hand, in passing a reference current IrefLED through the individual light emitting diodes LED1 to LEDn using the switching elements SW1 to SWn, the voltage may be very low because it suffices to turn on only one light emitting diode as shown in FIG. 11. Since configuring the DC-to-DC converter 7 so as to make the DC-to-DC converter 7 operable down to a very low voltage is inefficient, the DC-to-DC converter 70 as the measuring reference constant current circuit for passing the measuring reference constant current through the LED string 40 is connected via the selector switch 60.

The DC-to-DC converter 70 forms a feedback loop to detect a voltage drop by the detection resistance (Rref) 50 from a setting of an output voltage Vtest and pass the predetermined constant current (IrefLED).

When the reference current IrefLED is supplied from the DC-to-DC converter 70, the FET 6 is on at all times.

Figure 10:
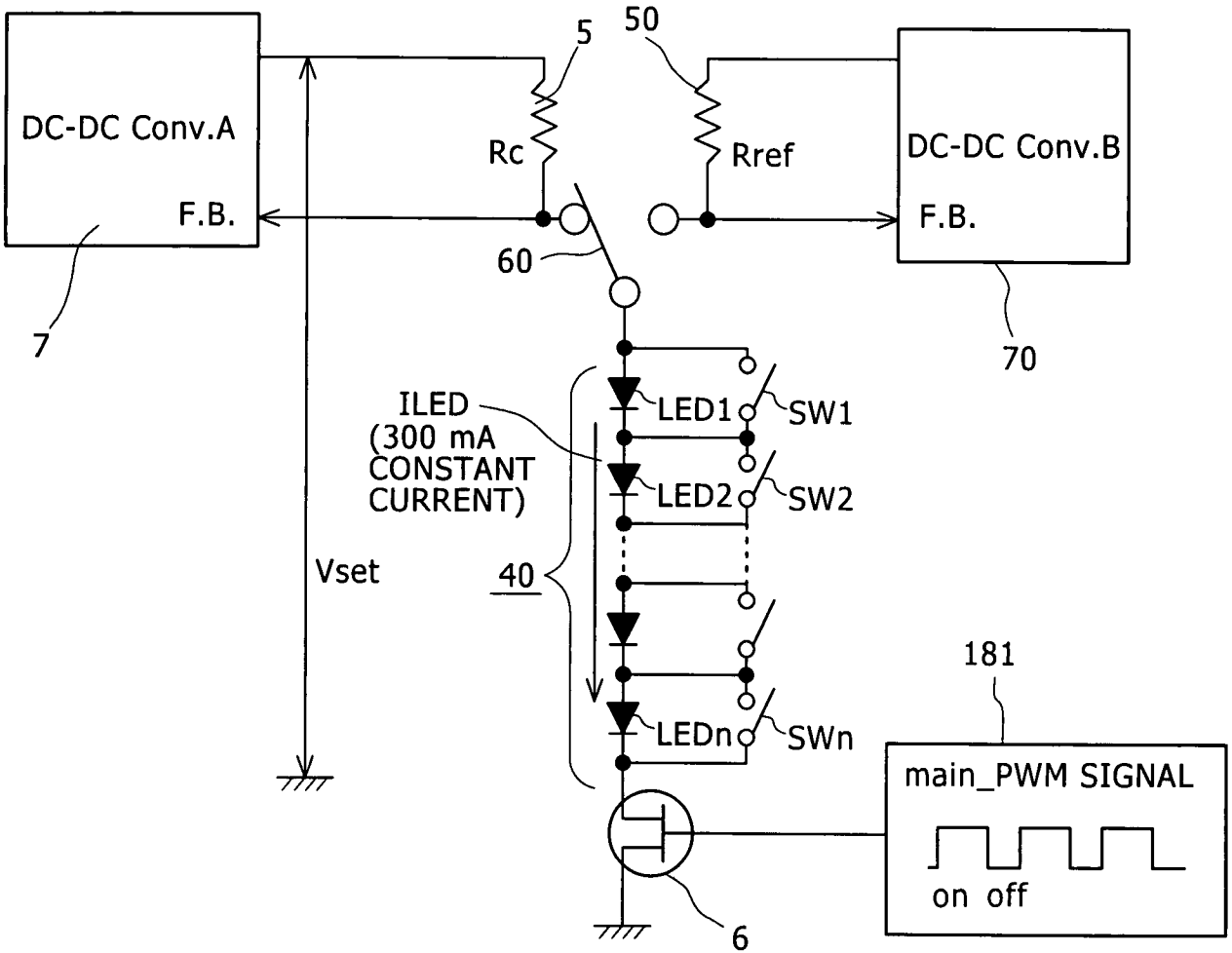
FIG. 10 is a diagram schematically showing a concrete example of a configuration for passing a constant current through a plurality of light emitting diodes connected in series with each other in the backlight light source device.

Incidentally, the LED string 40 as one group shown in FIG. 10 and FIG. 11 corresponds to one row of the RGB pairs g1 to gn corresponding to the n respective rows shown in FIG. 9. Hence, this example requires gn rows×3 (for RGB) circuits similar to the LED string 40.

There may be various cases regarding the number of LEDs 41 in the LED string 40 as one group shown in FIG. 10 and FIG. 11 because the number is varied in view of a light quantity balance. Particularly because of recent increase in power supplied to each element in order to reduce a total number, it is necessary to detect a variation in brightness characteristics of each element and overcome the variation by adjustment.

In this case, a transistor can be used as the switching elements SW1 to SWn. A switching control signal supplied to a base of the transistor enables control to bypass the driving current flowing through the plurality of light emitting diodes LED1 to LEDn connected in series with each other via the switching elements SW1 to SWn formed by the transistor individually.

Figure 12:
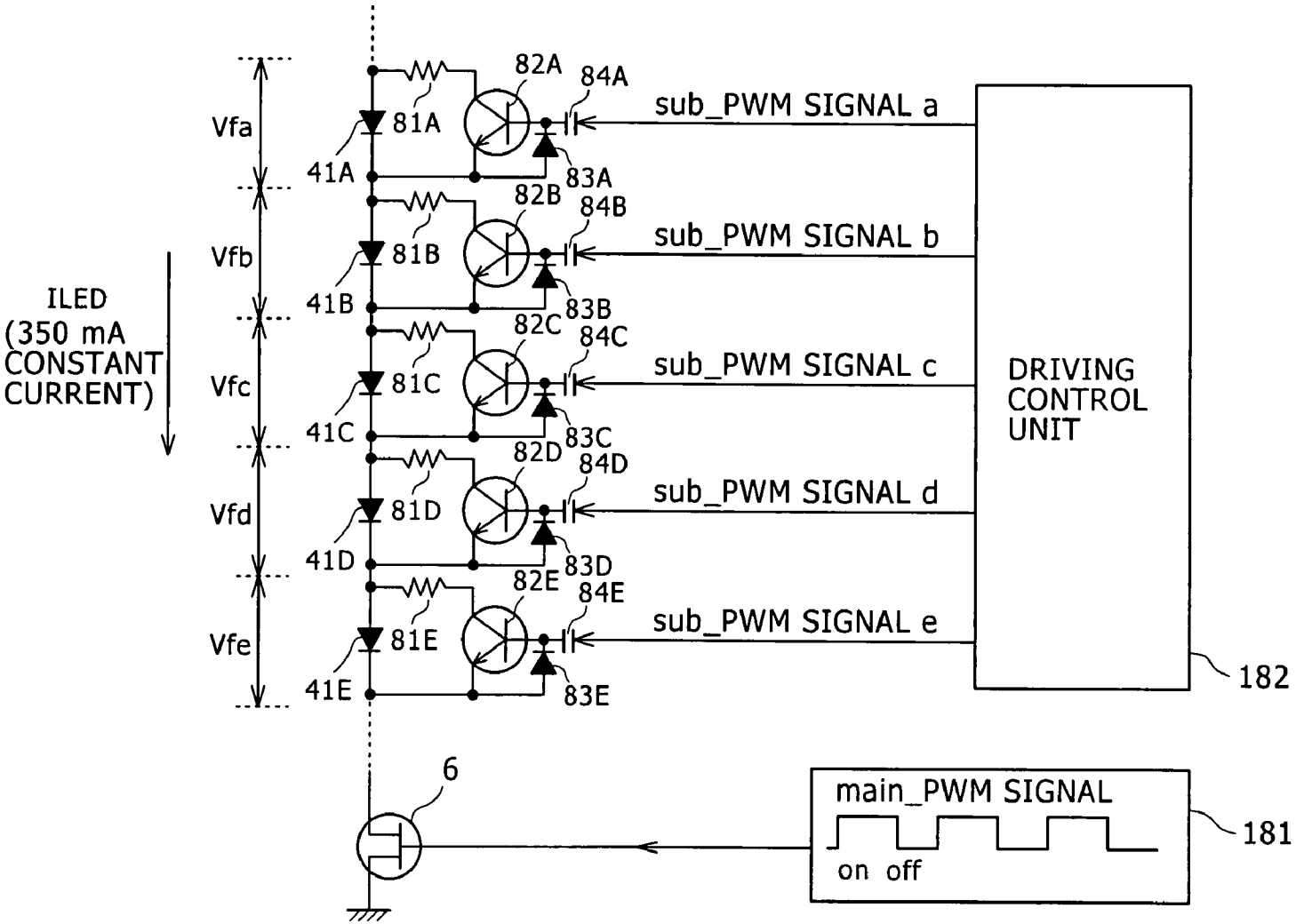
FIG. 12 is a diagram schematically showing an example of a configuration formed by connecting transistors as switching elements to a plurality of light emitting diodes connected in series with each other in the backlight light source device.

In a configuration shown in FIG. 12, for example, transistors 82A to 82E as switching elements are respectively connected in parallel with five light emitting diodes 41A to 41E connected in series with each other. Clamping diodes 83A to 83E are connected between a base and an emitter of the transistors 82A to 82E, respectively. Further, coupling capacitors 84A to 84E are connected to the base of the transistors 82A to 82E, respectively.

The five light emitting diodes 41A to 41E connected in series with each other have respective voltage drops Vfa to Vfe from a top to a bottom, and have variations according to a production lot. The five light emitting diodes 41A to 41E connected in series with each other are PWM-driven by a FET 6.

In a driving circuit of such a configuration, sub_PWM signals a to e are respectively supplied to the bases of the transistors 82A to 82E via the coupling capacitors 84A to 84E as switching control signals from a driving control unit 182 provided in the backlight driving control unit 180. Since emitter potential of the transistors 82A to 82E are clamped by the diodes 83A to 83E, the sub_PWM signals a to e input to the coupling capacitors 84A to 84E can be treated as an alternating-current signal. Thus, even with the series connection, on-off driving of the transistors 82A to 82E can be performed without consideration being given to the potential.

When the transistor 82A connected in parallel with the light emitting diode 41A is turned on, for example, a section between an anode and a cathode of the light emitting diode 41A is bypassed by a short circuit with an on resistance of the transistor 82A. Thus all of a driving current for the light emitting diode 41A flows through the transistor 82A, and the light emitting diode 41A does not light.

An example of operation in the configuration example shown in FIG. 12 will be described in the following with reference to FIG. 13.

Figure 13:
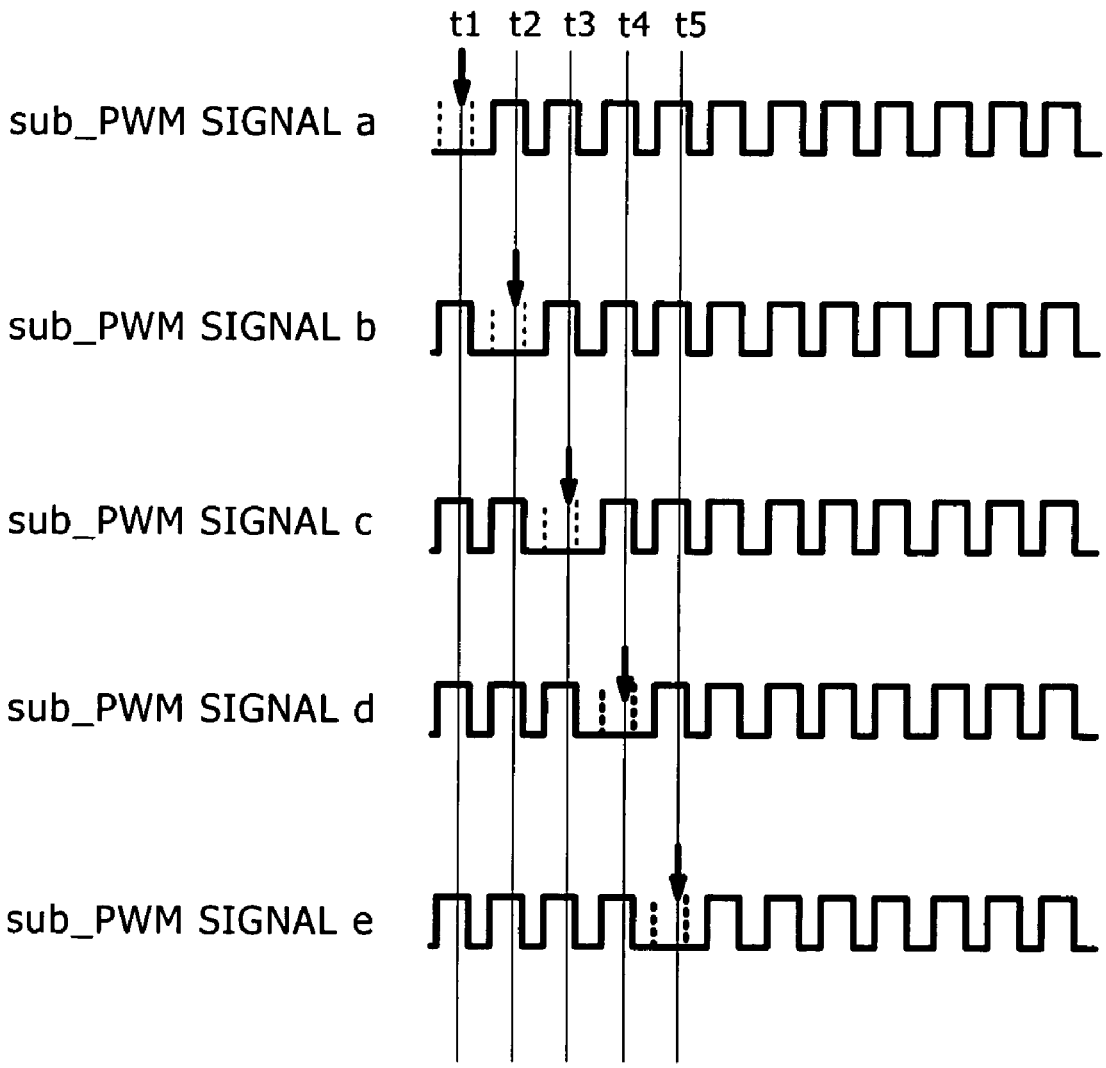
FIG. 13 is a waveform chart of assistance in explaining operation of the example of configuration formed by connecting the transistors as switching elements to the plurality of light emitting diodes connected in series with each other in the backlight light source device.

FIG. 13 shows waveforms of the sub_PWM signals a to e applied to the bases of the five transistors 82A to 82E connected in series with each other. Also, t1, t2, t3, t4, and t5 denote timing on a time base of FIG. 13.

At time t1, only the sub_PWM signal a is at a low level, and thus the transistor 82A is off. At time t1, all the transistors 82B to 82E are on, and thus only the light emitting diode 41A illuminates.

Similarly, the light emitting diodes 41B to 41E can be lit individually and sequentially; that is, the light emitting diode 41B is lit at time t2, the light emitting diode 41C is lit at time t3, the light emitting diode 41D is lit at time t4, and the light emitting diode 41E is lit at time t5. While the series connection of the five light emitting diodes is taken as an example in this case, similar operation is performed in a case of n light emitting diodes (n is an arbitrary number). When a bypassing time is adjusted by controlling an on-off period ratio, accuracy of the diverted current is increased, and a measuring time can be secured.

The sub_PWM signals a to e used to drive the transistors can be selected independently of the main_PWM signal, and thus provide a high degree of freedom. In addition, by increasing frequency of the sub_PWM signals a to e, it is possible to achieve a very short lighting time and thus enable quick lighting.

Description will next be made of detection of an LED failure in (3) the mode in which decrease in light quantity occurs as described above.

An LED failure in (3) the mode in which decrease in light quantity occurs can be detected by measuring an amount of light emission of light emitting diodes.

Figure 14:
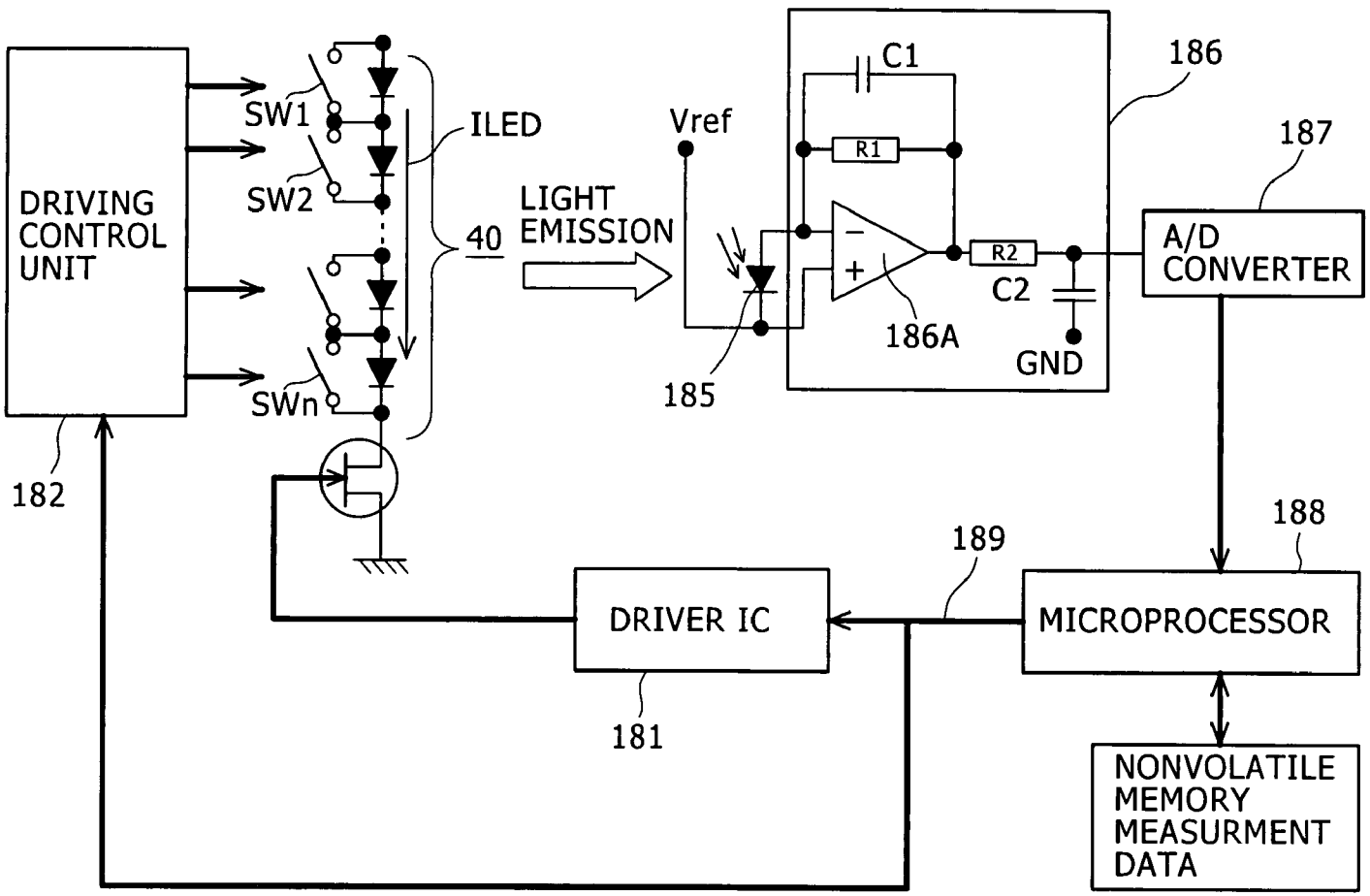
FIG. 14 is a diagram schematically showing an example of configuration for detecting an LED failure in a mode in which a decrease in amount of light emission occurs in a light emitting diode in the backlight light source device.

FIG. 14 shows an example of configuration for measuring an amount of light emission of light emitting diodes in the backlight light source device 20.

The backlight light source device 20 can selectively light an arbitrary and individual light emitting diode by the series of operations described above. Accordingly, an optical sensor for receiving light emitted by the plurality of light emitting diodes and detecting a quantity of the light is provided, the light emitting diodes to be measured through which to pass a measuring driving current are sequentially selected, and variations in amount of light emission between the plurality of light emitting diodes can be measured on the basis of detection output of the optical sensor.

For example, the configuration example shown in FIG. 14 has a photodiode 185 as an optical sensor for receiving light emitted from the plurality of light emitting diodes LED1 to LEDn connected in series with each other.

A detection output of the photodiode 185 is supplied to an A/D converter 187 via a current-to-voltage converter circuit 186 formed by an operational amplifier 186A, and then supplied as digital data to a microprocessor 188.

The microprocessor 188 supplies a driving setting control signal via a bus 189 to a driver IC 181 for PWM driving by switching control of a FET 6 connected to the plurality of light emitting diodes LED1 to LEDn connected in series with each other and a driving control unit 182 for supplying a switching control signal to switching elements SW1 to SWn respectively connected in parallel with the plurality of light emitting diodes LED1 to LEDn connected in series with each other. The microprocessor 188 performs control to bypass a driving current flowing through the other light emitting diodes than an arbitrary light emitting diode to be measured via the respective switching elements and thereby pass the measuring driving current through only the light emitting diode to be measured in a state of the FET 6 being on at all times. The microprocessor 188 sequentially selects the light emitting diodes to be measured through which to pass the measuring driving current, and measures variations in amount of light emission between the plurality of light emitting diodes on the basis of detection output of the optical sensor.

Specifically, the microprocessor 188 selects an arbitrary light emitting diode to light the light emitting diode for a very short time (for example 1 μs), detects a value at that time by the photodiode 185, and then stores the value in a memory. Since the light emitting diode is selected for the very short time, even when there are for example 360 light emitting diodes as in this example and the time of 1 μs is required for each individual light emitting diode, it takes a total of 360 μs.

Incidentally, when the light emitting diodes are used as a backlight light source for liquid crystal display, the optical sensor is not necessarily able to be disposed in the vicinity of the light emitting diodes, and is thus limited in terms of disposition and shape. In this case, because of the shape, there may be a case where light from a light emitting diode present at a distant position is detected as weak light and light from a light emitting diode present at a position close to the sensor is detected as strong light. This can be dealt with by for example preparing, as a memory table, correction value data obtained by optical simulation, actual measurement using a reference light emitting diode, or the like, and correcting data on an optically sensed light quantity.

The light emitting diode has a brightness characteristic degraded and an amount of light emission reduced with use for a long period of time. Thus, gradually increasing the driving current to maintain an amount of light emission shortens life of the light emitting diode. However, when the correction value data obtained with consideration given to change in brightness characteristics of the light emitting diode with the passage of time is prepared as the memory table and the microprocessor 188 performs control so as to reduce the driving current with time, it is possible to lengthen the life of the light emitting diode.

In this configuration example, it is possible to drive an arbitrary light emitting diode, and measure, store, and correct light emission output data, so that an individual light emitting diode whose amount of light emission is abnormally decreased can be identified.

Figure 15:
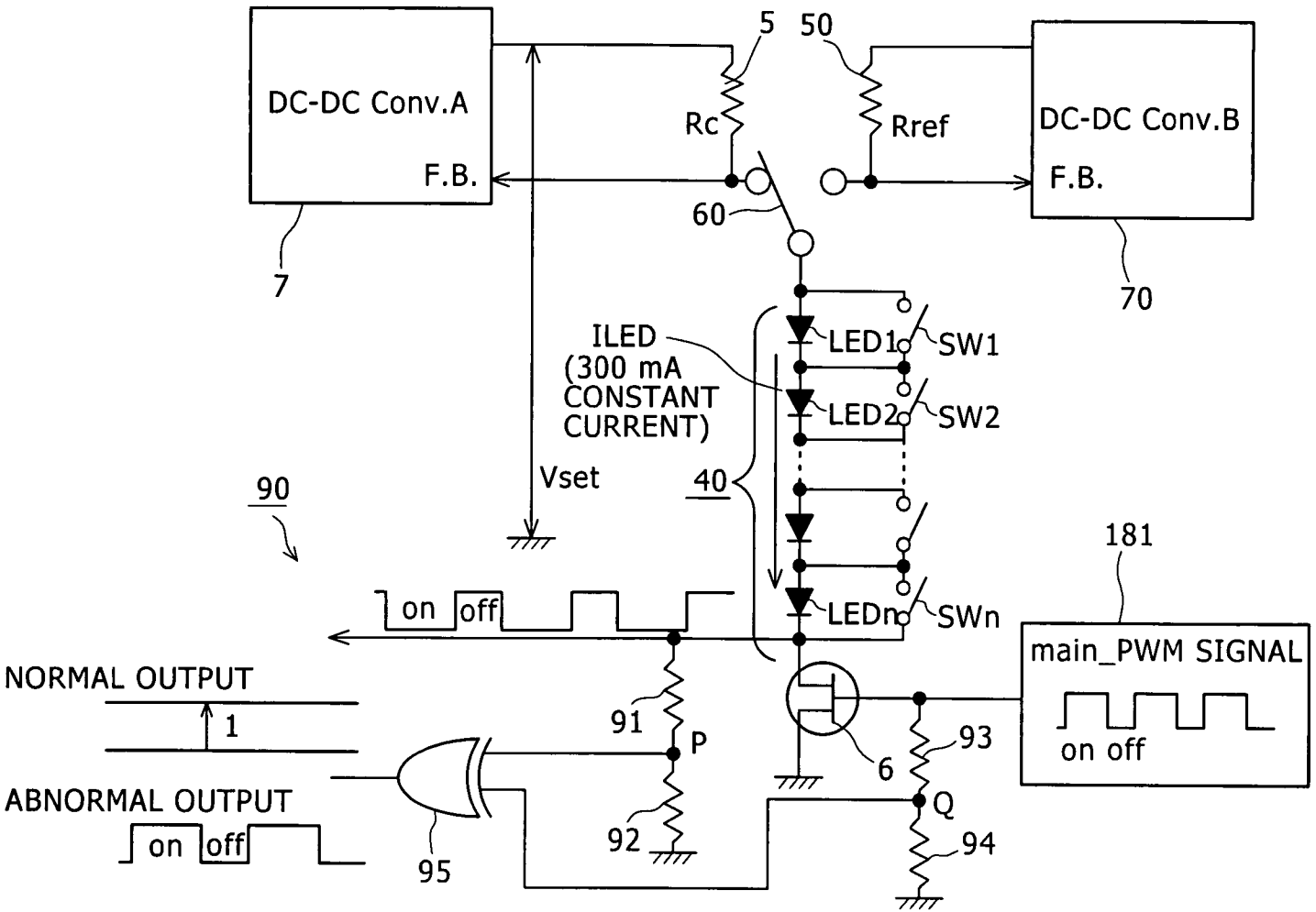
FIG. 15 is a diagram schematically showing an example of configuration for detecting an LED failure in an OPEN mode in which a disconnection occurs in a light emitting diode in the backlight light source device.

A method for avoiding (1) a failure in the OPEN mode described above as a failure mode in which a disconnection occurs will next be described with reference to FIGS. 15 to 17.

In an example of configuration shown in FIG. 15, a detection circuit 90 for detecting the driving current flowing through a plurality of light emitting diodes LED1 to LEDn connected in series with each other as described above and identifying a light emitting diode at a faulty position is provided as follows.

In the detection circuit 90, a point of connection between the plurality of light emitting diodes LED1 to LEDn connected in series with each other and a PWM driving FET 6 is grounded via voltage divider resistances 91 and 92. A gate of the FET 6 is grounded via voltage divider resistances 93 and 94. The detection circuit 90 identifies a light emitting diode at a faulty position by comparing a voltage obtained at a midpoint P of connection between the voltage divider resistances 91 and 92 with a voltage obtained at a midpoint Q of connection between the voltage divider resistances 93 and 94 by means of an exclusive OR gate 95.

In this detection circuit 90, since the FET 6 performs switching operation in response to a main_PWM signal supplied to the gate of the FET 6, when the plurality of light emitting diodes LED1 to LEDn connected in series with each other are in a normal state, the voltage obtained at the midpoint P of connection between the voltage divider resistances 91 and 92 and the voltage obtained at the midpoint Q of connection between the voltage divider resistances 93 and 94 are changed in opposite phase to each other, and thus output of the exclusive OR gate 95 is a logical "1" (Hi level) at all times.

When one of the plurality of light emitting diodes LED1 to LEDn connected in series with each other is opened, the potential at point P is at a Lo level at all times, and therefore the output of the exclusive OR gate 95 forms a rectangular wave similar to that of the main_PWM signal, which wave repeats a logical "1" and a logical "0."

Figure 16:
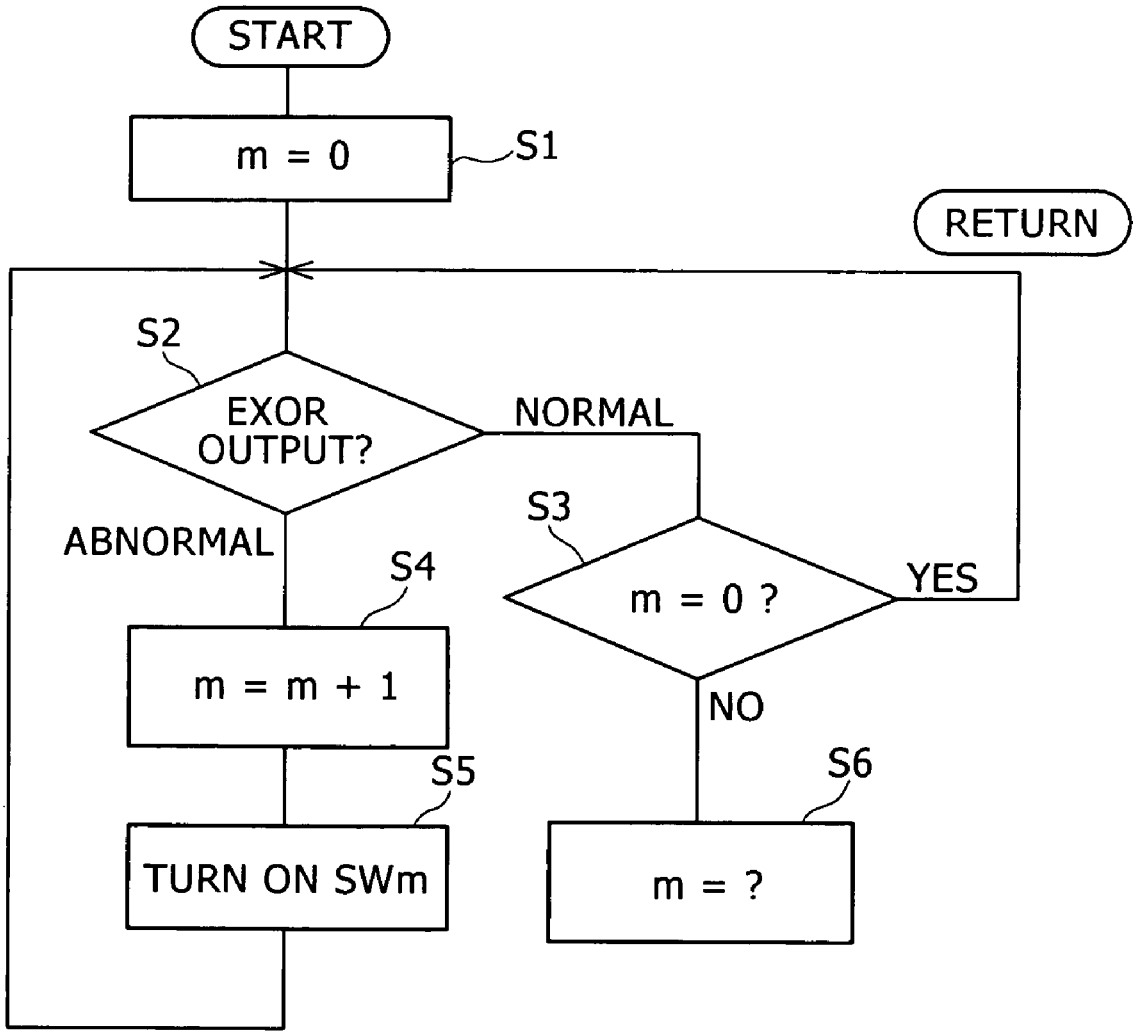
FIG. 16 is a flowchart of a procedure for identifying a light emitting diode at a faulty position when an LED failure in the OPEN mode occurs.

When the microprocessor 188 detects the rectangular wave, the microprocessor 188 controls the driving control unit 182 to sequentially turn on switching elements SW1 to SWn respectively connected in series with the plurality of light emitting diodes LED1 to LEDn connected in series with each other according to a procedure illustrated in a flowchart of FIG. 16. Thereby the microprocessor 188 can determine that "m" which is a switch number indicating one switching element SWm of the switching elements SW1 to SWn at a time of the output of the exclusive OR gate 95 becoming a logical "1" (Hi level) corresponds to the faulty part.

Specifically, the microprocessor 188 initializes a switch number m indicating one switching element SWm of the switching elements SW1 to SWn to be turned on to m=0, that is, performs the initialization so as to set all the switching elements SW1 to SWn in an off state (step S1). The microprocessor 188 determines whether the output of the exclusive OR gate 95 is in a normal state, in which the output of the exclusive OR gate 95 is a logical "1" (Hi level) at all times, or whether the output of the exclusive OR gate 95 is in an abnormal state, in which the output of the exclusive OR gate 95 forms a rectangular wave similar to that of the main_PWM signal (step S2).

When the output of the exclusive OR gate 95 is in the normal state, the microprocessor 188 determines whether the switch number m is m=0, that is, whether all the switching elements SW1 to SWn are in an off state (step S3).

When a result of the determination in step S3 is YES, that is, when all the switching elements SW1 to SWn are in an off state, the microprocessor 188 returns to step S2 described above to repeat the determination as to the output of the exclusive OR gate 95.

When the output of the exclusive OR gate 95 is in an abnormal state as a result of the determination in step S2 described above, the microprocessor 188 increments the number m (m=m+1) (step S4), and turns on the switching element SWm (step S5). Then the microprocessor 188 returns to step S2 described above to repeat the process of determination as to the output of the exclusive OR gate 95.

Thereafter, when the output of the exclusive OR gate 95 is changed to a normal state as a result of determination in step S2 described above, the microprocessor 188 proceeds to step S3 described above to determine whether the switch number m is m=0, and then determines that the light emitting diode LEDm connected in parallel with the switching element SWm indicated by the switch number m when the output of the exclusive OR gate 95 is changed to a normal state is faulty in the OPEN mode (step S6).

Figure 17:
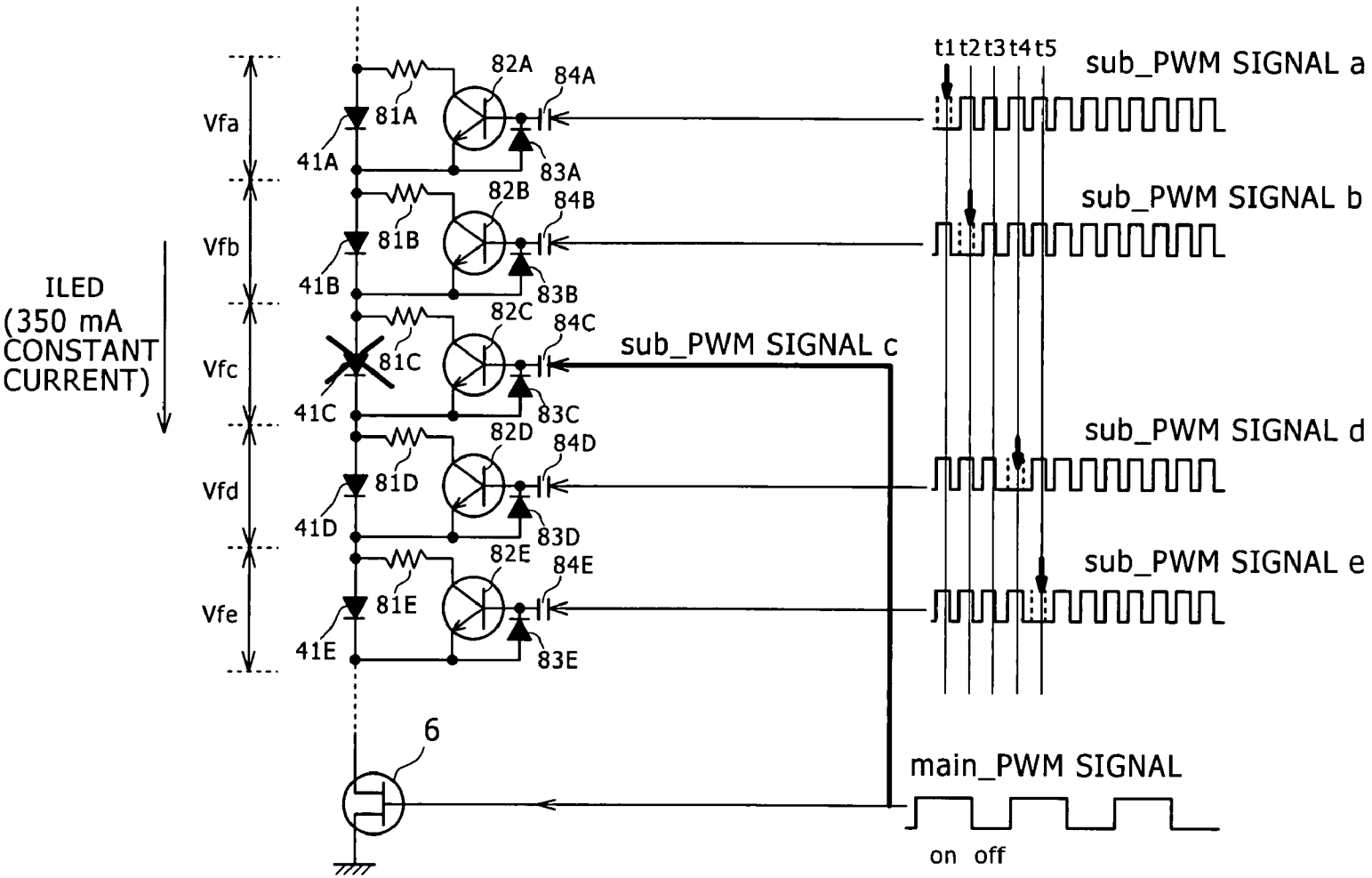
FIG. 17 is a diagram schematically showing an operation for bypassing a driving current flowing to a light emitting diode at a faulty position.

Suppose that the microprocessor 188 determines that m=3, that is, the third light emitting diode is faulty (OPEN), as shown in FIG. 17, the third light emitting diode 41C judged to be the faulty part is recognized as faulty, and the transistor 82C as the switching element connected in parallel with the light emitting diode 41C is supplied with the same main_PWM signal as that supplied to the FET 6 as a switching control signal to be thereby turned on and off in synchronism with the FET 6, whereby the driving current flowing to the light emitting diode 41C recognized as faulty can be bypassed via the transistor 82C.

Description will next be made of (2) a failure in the Short mode described above as a failure mode in which a short circuit occurs. In a case of a short circuit in this configuration example, because of constant current control, the output voltage Vset of the DC-to-DC converter 7 is automatically decreased by a voltage corresponding to one diode, and the configuration example functions normally as an electric circuit. When the above-described optical detection mechanism is provided, the faulty diode can be identified. Since a short circuit failure is only an abnormal state, the state may change or make a transition to (1) the OPEN mode in which a disconnection occurs. This case can be dealt with by the above-described method.

What is claimed is:

1. A constant current driving device for constant current driving of a plurality of elements connected in series with each other by a pulse width modulation constant current driving circuit, said constant current driving device comprising:

switching elements respectively connected in parallel with said plurality of elements connected in series with each other;

a control circuit for performing control to bypass a driving current flowing through the other elements than an arbitrary element to be measured via the respective switching elements and pass a measuring driving current through only the element to be measured; and a detecting circuit for identifying an element at a faulty position by detecting the driving current flowing through said plurality of elements connected in series with each other.

2. A constant current driving device as claimed in claim 1, wherein a main constant current circuit for constant current driving of said plurality of elements connected in series with each other by the pulse width modulation constant current driving circuit and a measuring reference constant current circuit are selectively connectable to said plurality of elements connected in series with each other via a switching unit.

3. A constant current driving device as claimed in claim 2, wherein said switching elements are each formed of a transistor; and said control circuit performs control to bypass a driving current flowing through said plurality of elements connected in series with each other via switching elements formed of said transistor individually.

4. A constant current driving device as claimed in claim 3, wherein said switching elements each include a diode connected between a base and an emitter of said transistor and a capacitor connected to the base of said transistor; and said control circuit performs the control to bypass the driving current flowing through said plurality of elements connected in series with each other via the switching elements formed of said transistor individually by supplying a switching control signal to the base of said transistor via said capacitor.

5. A constant current driving device as claimed in claim 3, wherein said control circuit performs control to bypass the driving current flowing to the element at the faulty position at all times by operating a switching element formed by said transistor connected in parallel with the element at the faulty position, the element at the faulty position being identified by said detecting circuit, in synchronism with pulse width modulation driving by said pulse width modulation constant current driving circuit.

6. A constant current driving device as claimed in claim 1, wherein said plurality of elements connected in series with each other are light emitting diodes.

7. A backlight light source device for lighting a display panel from a back side of the display panel, said backlight light source device comprising:

a plurality of light emitting diodes connected in series with each other;

switching elements respectively connected in parallel with said plurality of light emitting diodes connected in series with each other;

a control circuit for performing control to bypass a driving current flowing through the other light emitting diodes than an arbitrary light emitting diode to be measured via the respective switching elements and pass a measuring driving current through only the light emitting diode to be measured; and a detecting circuit for identifying a light emitting diode at a faulty position by detecting the driving current flowing through said plurality of light emitting diodes connected in series with each other.

8. A backlight light source device as claimed in claim 7, wherein a main constant current circuit for constant current driving of said plurality of light emitting diodes connected in series with each other by a pulse width modulation constant current driving circuit and a measuring reference constant current circuit are selectively connectable to said plurality of light emitting diodes connected in series with each other via a switching unit.

9. A backlight light source device as claimed in claim 8, wherein said switching elements are each formed of a transistor; and said control circuit performs control to bypass a driving current flowing through said plurality of light emitting diodes connected in series with each other via switching elements formed of said transistor individually.

10. A backlight light source device as claimed in claim 9, wherein said switching elements each include a diode connected between a base and an emitter of said transistor and a capacitor connected to the base of said transistor; and said control circuit performs the control to bypass the driving current flowing through said plurality of light emitting diodes connected in series with each other via the switching elements formed of said transistor individually by supplying a switching control signal to the base of said transistor via said capacitor.

11. A backlight light source device as claimed in claim 9, wherein said control circuit performs control to bypass the driving current flowing to the light emitting diode at the faulty position at all times by operating a switching element formed by said transistor connected in parallel with the light emitting diode at the faulty position, the light emitting diode at the faulty position being identified by said detecting circuit, in synchronism with pulse width modulation driving by said pulse width modulation constant current driving circuit.

12. A color liquid crystal display device comprising:

a transmissive type color liquid crystal display panel having a color filter; and a backlight light source device for lighting the color liquid crystal display panel from a back side of the color liquid crystal display panel;

wherein said backlight light source device includes:

a plurality of light emitting diodes connected in series with each other;

switching elements respectively connected in parallel with said plurality of light emitting diodes connected in series with each other;

a control circuit for performing control to bypass a driving current flowing through the other light emitting diodes than an arbitrary light emitting diode to be measured via the respective switching elements and pass a measuring driving current through only the light emitting diode to be measured; and a detecting circuit for identifying a light emitting diode at a faulty position by detecting the driving current flowing through said plurality of light emitting diodes connected in series with each other.

13. A color liquid crystal display device as claimed in claim 12, wherein a main constant current circuit for constant current driving of said plurality of light emitting diodes connected in series with each other by a pulse width modulation constant current driving circuit and a measuring reference constant current circuit are selectively connectable to said plurality of light emitting diodes connected in series with each other via a switching unit.

14. A color liquid crystal display device as claimed in claim 13, wherein said switching elements are each formed of a transistor; and said control circuit performs control to bypass a driving current flowing through said plurality of light emitting diodes connected in series with each other via switching elements formed of said transistor individually.

15. A color liquid crystal display device as claimed in claim 14, wherein said switching elements each include a diode connected between a base and an emitter of said transistor and a capacitor connected to the base of said transistor; and said control circuit performs the control to bypass the driving current flowing through said plurality of light emitting diodes connected in series with each other via the switching elements formed of said transistor individually by supplying a switching control signal to the base of said transistor via said capacitor.

16. A color liquid crystal display device as claimed in claim 14, wherein said control circuit performs control to bypass the driving current flowing to the light emitting diode at the faulty position at all times by operating a switching element formed by said transistor connected in parallel with the light emitting diode at the faulty position, the light emitting diode at the faulty position being identified by said detecting circuit, in synchronism with pulse width modulation driving by said pulse width modulation constant current driving circuit.

* * * * *